United States Patent [19]

Oswalt et al.

[11] Patent Number: 4,769,998

[45] Date of Patent: Sep. 13, 1988

[54] PRECISION-CONTROLLED WATER CHILLER

[75] Inventors: Philip D. Oswalt, Indianapolis; Harold R. Short; Steven E. Wash, both of Greenwood, all of Ind.

[73] Assignees: Advantage Electronics, Incorporated; Advantage Engineering, Incorporated, both of Greenwood, Ind.

[21] Appl. No.: 856,033

[22] Filed: Apr. 25, 1986

[51] Int. Cl.[4] ..... F25D 17/02

[52] U.S. Cl. ..... 62/98; 62/185; 62/201

[58] Field of Search ..... 62/201, 196.4, 185, 62/117, 98

[56] References Cited

U.S. PATENT DOCUMENTS

| | | | |
|---|---|---|---|
| 2,556,882 | 6/1951 | Minkler et al. | 62/185 X |
| 3,822,566 | 7/1974 | Lowi, Jr. | 62/435 |
| 3,859,812 | 1/1975 | Pavlak | 62/99 |
| 4,248,055 | 2/1981 | Day, III et al. | 62/201 X |
| 4,457,358 | 7/1984 | Kriege et al. | 165/50 |
| 4,495,777 | 1/1985 | Babington | 62/185 |
| 4,502,289 | 3/1985 | Kayama | 62/185 |
| 4,517,808 | 5/1985 | Movshovitz | 62/160 |
| 4,546,618 | 10/1985 | Kountz et al. | 62/201 |

*Primary Examiner*—William E. Wayner

*Attorney, Agent, or Firm*—Woodard, Emhardt, Naughton Moriarty & McNett

[57] ABSTRACT

A mechanically refrigerated chiller system for a process coolant has a process coolant circuit which includes a coolant reservoir with refrigerant evaporator coils in it. Coolant returns from the process to the reservoir through several and alternate paths. An additional coolant path is provided through a heat exchanger. An extra hot-gas line from the high pressure side of the refrigerant compressor is coupled through the heat exchanger to the refrigerant condenser. When the temperature of the coolant is too low, adjustment is made by adding heat to some of the coolant in the heat exchanger. Coolant temperature is sensed in an area where coolant returns from the process through a direct path and in another area where the coolant is leaving the evaporator through the aforementioned heat exchanger are mixed with a portion of the reservoir coolant.

5 Claims, 6 Drawing Sheets

PRECISION-CONTROLLED WATER CHILLER

BACKGROUND OF THE INVENTION

This invention relates generally to water chillers, and more particularly to a system providing precision-control of process water temperature over a broad range of loads.

Water is widely used as a coolant for equipment used in various processes. It is used in rubber and plastics processing, calendaring, coating, printing, chemical processing, laminating, and many other manufacturing processes. Injection molding machines and industrial laser machines are examples where intermittent cooling loads, and substantial variations in cooling loads, must be handled. In addition, manufacturers and users of such equipment find that better performance and process quality can be achieved if coolant temperatures are stable.

Typical chillers of thirty tons and less are designed to have the refrigeration capacity sufficient to handle the largest cooling loads that will be imposed on them. Refrigerating systems having reciprocating compressors are typically provided with condenser by-pass paths or compressor unloading systems to avoid excessive cooling during light load conditions. These are typically designed to reduce the system cooling performance approximately 50 percent. Further reductions in cooling performance below 50%, particularly in systems under twenty tons, usually are not done by compressor unloading or hot gas by-pass techniques, and may ultimately require shutting down the compressor.

U.S. Pat. No. 3,859,812 to Pavlak discloses the use of cylinder unloading and hot gas by-pass to reduce refrigeration performance in a cooling system for machine tool coolant. U.S. Pat. No. 4,546,618 to Kountz et al. discloses a complex capacity control system for refrigeration in a water chiller, using compressor speed and vane control. The Kazama Patent No. 4,502,289 discloses cold water supply systems with supply and return tanks and cold water temperature and level sensing and a computer 80 to control pumps, valves, and refrigerators for water temperature control. It refers to prior art FIGS. 1 and 2 disclosing return cold water temperature measured by sensor 22 in return water tank 24, and computer 14 responding to control capacity of turbo refrigerators 20 by using their automatic vane control feature. The asserted improvement involves mixing suitable amounts of water directly from the return tank and from the refrigerators, in the supply tank.

Cycling of compressors is detrimental to the compressors and associated equipment. It may also have a negative impact on the electrical power factor of the manufacturing plant. Large temperature swings of the chilled water usually result when temperature control is attempted by the starting and stopping of the compressor. Such swings, of 5° F. or more, can be intolerable in processing eguipment. The present invention is the result of efforts to provide a stable cooling fluid temperature at light loads as well as heavy loads and at various loads between light and heavy, and without detriment to the chiller system.

SUMMARY OF THE INVENTION

Described briefly, according to a typical embodiment of the present invention, a process cooling fluid circuit includes a reservoir from which the cooling fluid is pumped to the processing equipment which is to be cooled. The fluid return from the processing equipment to the reservoir has two paths. There is a direct return path, and there is a path through a power-operated valve. A load by-pass line is provided from the pump through a precision control heat exchanger and power-operated valve back to the reservoir. A mechanical refrigeration system includes a hot gas path through the precision control heat exchanger and which is in parallel with a direct hot gas path to the refrigerant condenser.

An automatic controller senses temperature of cooling fluid returning from the processing equipment (load) and the temperature of cooling fluid at reservoir outlet to the pump intake. It processes the temperature information, and controls the conventional hot-gas by-pass valve of the refrigeration system and controls the above mentioned powered valves, operating the valves in duty-cycle cadences as needed to establish and maintain the desired "to process" cooling fluid temperature, regardless of load. If the cooling fluid returning from the processing equipment is cooler than desired, some of the flow of cooling fluid pumped from the reservoir is shunted past the load through the heat exchanger to cause heat transfer from compressor high pressure side gas to the cooling fluid. The heated cooling fluid is mixed with the cooling fluid in the reservoir which is actually a part of the evaporator assembly of the mechanical refrigeration system. When the mix temperature has risen to the desired level, the flow of cooling fluid through the heat exchanger is modified or terminated, to discontinue addition of heat to the coolant.

DESCRIPTION OF THE PREFERRED EMBODIMENT

Figure 1:
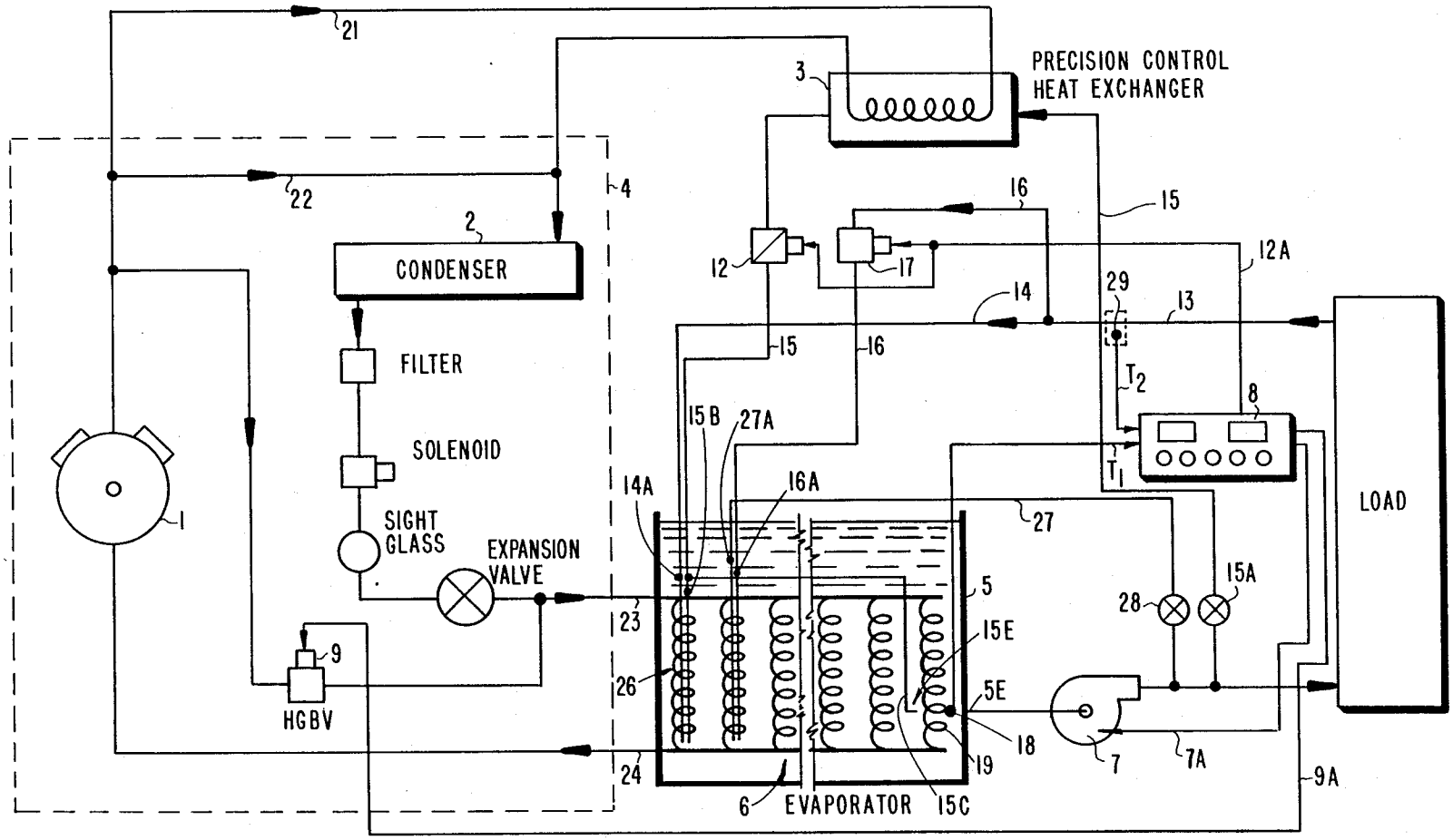
FIG. 1 is a schematic diagram of a chiller system according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, and particularly FIG. 1, a somewhat conventional refrigeration system for the chiller is included within the dotted outline block at the left. This includes the compressor 1 compressing the refrigerant which is passed through condenser 2, a filter, liquid-line solenoid valve, sight glass, and expansion valve. A hot gas by-pass line is connected from the high pressure gas side of the compressor through the normally-closed solenoid-operated hot gas by-pass valve (HGBV) 9 to the downstream side of the expansion valve.

According to one aspect of the present invention, a process cooling fluid reservoir is provided in the tank 5, and the refrigerant coils 19 are immersed in the coolant in the tank, thus providing an immersion-type evaporator assembly 6. So, the refrigerant downstream of the expansion valve passes through the coils immersed in the process coolant (normally water) and returns to the compressor. A portion of the tank and coils is omitted from FIG. 1 to conserve space in the drawing.

Referring further to FIG. 1, a pump 7 delivers the chilled cooling water from the tank 5 to the load, which is typically some kind of equipment involved in a process. An example would be an industrial laser machine or an injection molding machine for plastic, or a series of such machines. The water is returned from the process in line 13 and has two possible paths to the reservoir. One path is a direct path 14 to a manifold 14A having five pipes discharging downward into the reservoir. Another is the path 16 through the normally open solenoid-operated valve 17 to manifold 16A having five pipes discharging downward into the reservoir.

A load by-pass line 15 goes from pump 7 through orifice valve 15A, through the precision control heat exchanger 3 and normally-closed, solenoid-operated valve 12 and to a manifold 15B having five pipes which discharge in a downward direction into the reservoir. A branch 15C from line 15 has a outlet 15E directed toward the reservoir outlet 5E connected to the pump inlet.

A temperature sensing transducer 18 is located in the reservoir between the branch outlet 15E and tank outlet 5E, where it will sense the "to process" temperature $T_1$ of the mix of water leaving the tank to the pump inlet.

It was mentioned above, that there is a hot gas by-pass path through the normally closed, solenoid-operated valve 9, in conventional manner. According to a feature of the present invention, another hot gas path is provided through line 21 from the high pressure side of the compressor through the precision control heat exchanger 3 into the condenser 2. This line is somewhat smaller in diameter than the direct line 22 from the compressor to the condenser 2. So the refrigerant flow through it is not as great. Its purpose is to provide heat to coolant water when by-passed through line 15 from the pump to the reservoir. This is done when the valves 12 and 17 are switched to open and closed conditions, respectively. A controller 8 has analog signal input lines for temperature $T_1$ of coolant to the process (from sensor 18), and temperature $T_2$ of coolant from the process (from sensor 29). It has control signal output line 7A to pump 7, line 12A to valves 12 and 17, and line 9A to the hot-gas by-pass valve 9. So the controller can switch these valves as needed in response to the sensing of coolant temperature. According to one aspect of this invention, valve control is done according to duty cycle switching cadences as will be described.

Figure 2:
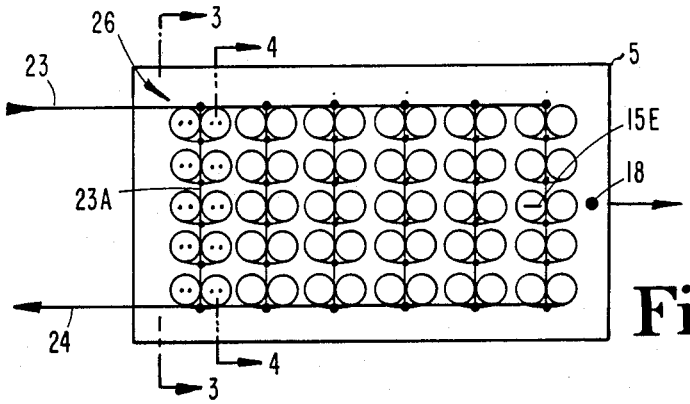
FIG. 2 is a schematic top view of the evaporator assembly.
Figure 3:
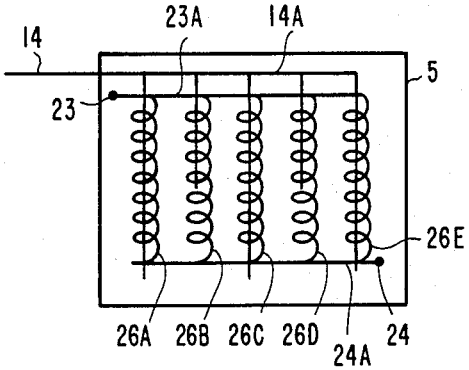
FIG. 3 is a schematic view of one arrangement of manifold and pipes in the evaporator assembly at line 3—3 in FIG. 2 and viewed in the direction of the arrows.
Figure 4:
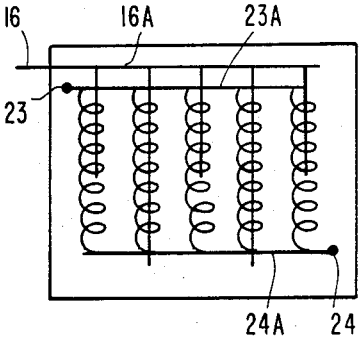
FIG. 4 is a schematic view of the other arrangement of manifold and pipes in the evaporator assembly at line 4—4 in FIG. 2 and viewed in the direction of the arrows.
Figure 5:
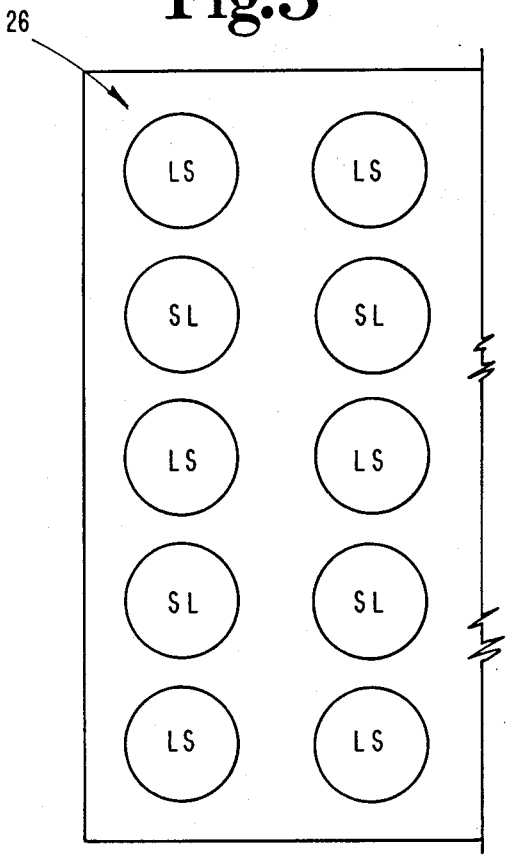
FIG. 5 is an enlarged diagram of the tube length arrangement in the evaporator assembly.

Referring now to FIGS. 2, 3 and 4, the arrangement of coils and coolant discharge tubes in the refrigerant evaporator reservoir can be understood. The refrigerant output from the expansion valve to the evaporator coils is at 23, and the return is at 24. There are shown twelve parallel rows of coils, each row having five coils connected in parallel between the refrigerant intake line 23 and outlet or compressor suction line 24. For example, the first row 26 includes the coils 26A–26E on the left side of refrigerant supply manifold branch 23A to which the top of each coil is connected. The lower end of each coil is connected to the refrigerant return manifold branch 24A (FIG. 3). The coolant discharge pipes extend down through the coils in the first two rows. For example, for the manifold 14A, the five discharge pipes from manifold 14A extend through the center of the coils 26A–26E. The outside pipes and the center pipe extend entirely through the coils (as in FIG. 3), while the second and fourth pipes extend only half way down. Similarly, the pipes from manifold 15B extend down through the same coils behind the pipes from manifold 14A. But in this case the outer and center pipe are the short pipes (as shown in FIG. 4 for manifold 16A), extending only half the way down in the coils while the second and fourth pipes are the full length of the coil, extending down through the bottom of the coils 26B and 26D. FIG. 5 symbolically designates this arrangement of pipes by using the letter "L" for the long pipe and the letter "S" for the short pipe. Similarly, in the second row of coils, pipes extend down from manifold 16A, with the short pipes being the outboard and center pipe, and the long pipes being the intermediate pipes. There is an additional row of pipes in the second row of coils. They extend from a manifold 27A and, from the left to the right in FIGS. 1 and 5 they are the third row of pipes. In this row, the arrangement of long and short pipes is the same as in the first row for manifold 14A. Manifold 27A is supplied by a pump by-pass line 27 from the pump 7 through the pump by-pass and flow control valve 28. While a valve is shown at 28, a valve, as such is not necessary, because a fixed restrictor of suitable size can suffice. This is because the objective is to provide a restriction in flow from the pump back to the tank and which will by-pass only enough coolant to assure turbulence, blending and mixing in the reservoir, and thereby a good blend and mixing of coolant returning from line 14 and 15 or 16, regardless of whether or not the flow rate through the process is low. Therefore, even if the valve 12 has been closed for a prolonged time, resulting in the non-flowing coolant in heat exchanger 3 getting very hot, the entry of that hot fluid into the tank when valve 12 does open, will not unduly affect the sensor 18.

Generally speaking, the evaporator is rather large and fairly inefficient as a heat transfer device, by today's standards of efficiency. This aspect is used beneficially according to the present invention. The coolant fluid entry to the tank is provided by the pipes downwardly discharging from the four manifolds toward the bottom of the tank, both long and short pipes being used from all four manifolds to provide thorough mixing of all of the coolant entering the tank. All of this is done inside the coils at the inlet end of the tank, with the flow of the mixed discharges moving toward the outlet (from left to right in FIG. 1) where the mix temperature is sensed at 18 immediately ahead of the outlet to the pump suction port. The direction of the one discharge branch pipe 15C from the line 15 provides a type of sampling of the effect being achieved by the precision control heat exchanger to anticipate its impact on the entire contents of the tank, just as the location of the sensor 29 at the return line from the process enables the controller to anticipate the amount of adjustment needed to compensate for any load change.

The relatively large tank serves as a thermal buffer for the system and enables the modulation of the condition of the hot gas by-pass valve 9, and the precision control valves 12 and 17 to provide temperature stability.

Figure 6:
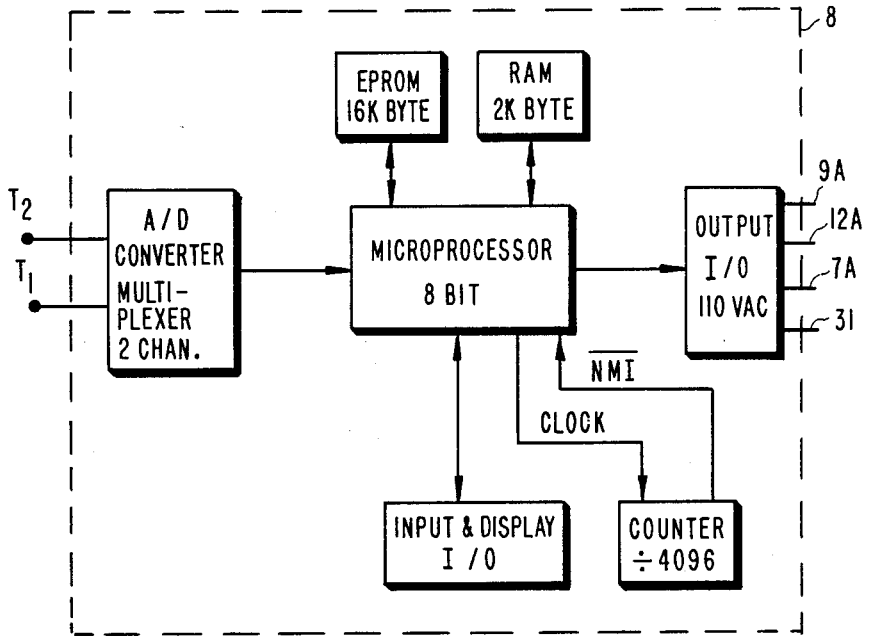
FIG. 6 is a block diagram of the controller.

Referring now to FIG. 6, the block diagram of the controller hardware is shown. The analog temperature inputs are shown labeled $T_1$ and $T_2$, and the control signal outputs are labeled 7A, 9A, and 12A, all as in FIG. 1. The signal output on line 7A is to start the pump. An additional output 31 may be provided for an alarm indicator lamp, bell or the like. A one Mhz clock signal is frequency divided by 4096 to provide a non-maskable interrupt (NMI) signal occurring about 244 times per second, for an NMI routine to be executed every 4.096 milliseconds. The NMI system is used in the preferred embodiment to establish a high priority for the cadences of the valves.

The input and display I/O box should be understood to have provisions for the following switch inputs from the control panel of the control shown generally in FIG. 1. They are as follows:

1. Set up
2. Return fluid temperature
3. Increase parameter
4. Decrease parameter
5. Hot-gas by-pass valve overide
6. Start
7. Stop For the display, two or more windows can be used for digital displays which are typically, the to-process temperature, the error code, the temperature set point, and the status indication of the control outputs.

OPERATION

In operation, and assuming that the processing equipment to be cooled is an industrial laser, the heat generated in the laser must be removed. Water is pumped from the reservoir 5 by the pump 7, is delivered through the laser cooling paths, and returns through lines 14 and 16 to the reservoir. The chiller compressor 1 is started and runs continuously. When the chiller is started, each of the precision control valves is in the condition shown in FIG. 1, with valve 12 in the normally-closed condition, and valve 17 in the normally-open condition. Hot gas by-pass valve 9 is normally closed. The refrigerant in the coils 19 cools the water in the reservoir. This condition will achieve maximum cooling. Meanwhile, no water is flowing through the precision-control heat exchanger 3 of the present invention, because valve 12 is normally closed.

It is intended that the refrigeration capacity of the system exceed the maximum possible heat load imposed by the water coming from the laser. But to avoid excessive cooling, particularly under part load conditions, it is another feature of this invention to establish duty cycles for the valves, and maintain or change them as needed to establish and maintain the desired coolant temperature.

The controller establishes duty cycles for the hot gas by-pass valve. For example, it can cause the valve to be open 16.6%, 33.3%, 50%, 66.6%, 83.3% or 100% of the time. If the valve is open 100% of the time, the refrigeration system capacity is reduced approximately 50%.

So the controller establishes the duty cycle of the hot gas by-pass valve, establishing a fairly fixed cadence of the valve such as "on", or open, 16.6%, 33.3%, 50%, 66.6%, 83.3% or 100% of the time. This establishes a base of chilling capacity. Beyond that, the controller establishes a fine control of the chilling system by the use of the precision control valves 12 and 17, establishing and changing their duty cycle as needed. In one implementation of the algorithm, the modulation levels of hot gas by-pass control valve (HGBV) in terms of valve on (open) time are as follows:

TABLE I

| Mod. Level | On (Open)% | Seconds On | Seconds Off | Mean Refrigeration Capacity % |
|---|---|---|---|---|
| 0 | 0 | 0 | 30 | 100 |
| 1 | 16.6 | 5 | 25 | 91.7 |
| 2 | 33.3 | 10 | 20 | 83.4 |
| 3 | 50 | 15 | 15 | 75 |
| 4 | 66.6 | 20 | 10 | 66.7 |
| 5 | 83.3 | 25 | 5 | 58.4 |
| 6 | 100 | 30 | 0 | 50 |

The term "mean capacity" as used herein refers to the refrigeration capacity of the chiller system achievable in a stable state of operation with the hot gas by-pass valve operating at a given duty cycle, with a constant level of loading on the system. As shown on the above table, it will run anywhere from 50% to 100% with the hot gas by-pass valve duty cycle on from 100% of the time, to none of the time. The determination of mean capacity as it applies to the effect of the hot-gas by-pass valve, assumes no flow of coolant through the precision control heat exchanger.

A table of the desired valve-"on" period during the thirty second cycle at the various levels of modulation, is as follows, where the bar represents the "on" time.

TABLE II

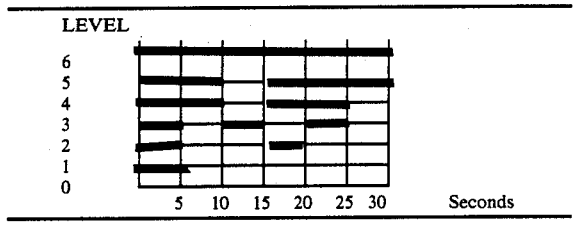

The precision control valves will be modulated timewise depending upon the controller's responses to temperatures sensed at 29 and 18. If the adjustment needed cannot be achieved with valves 12 and 17 alone, the controller will establish a different level of hot gas by-pass valve modulation, either increasing or decreasing the "on" time, depending upon whether the tendency of the from-process temperature is downward or upward from the desired level.

Figure 7:
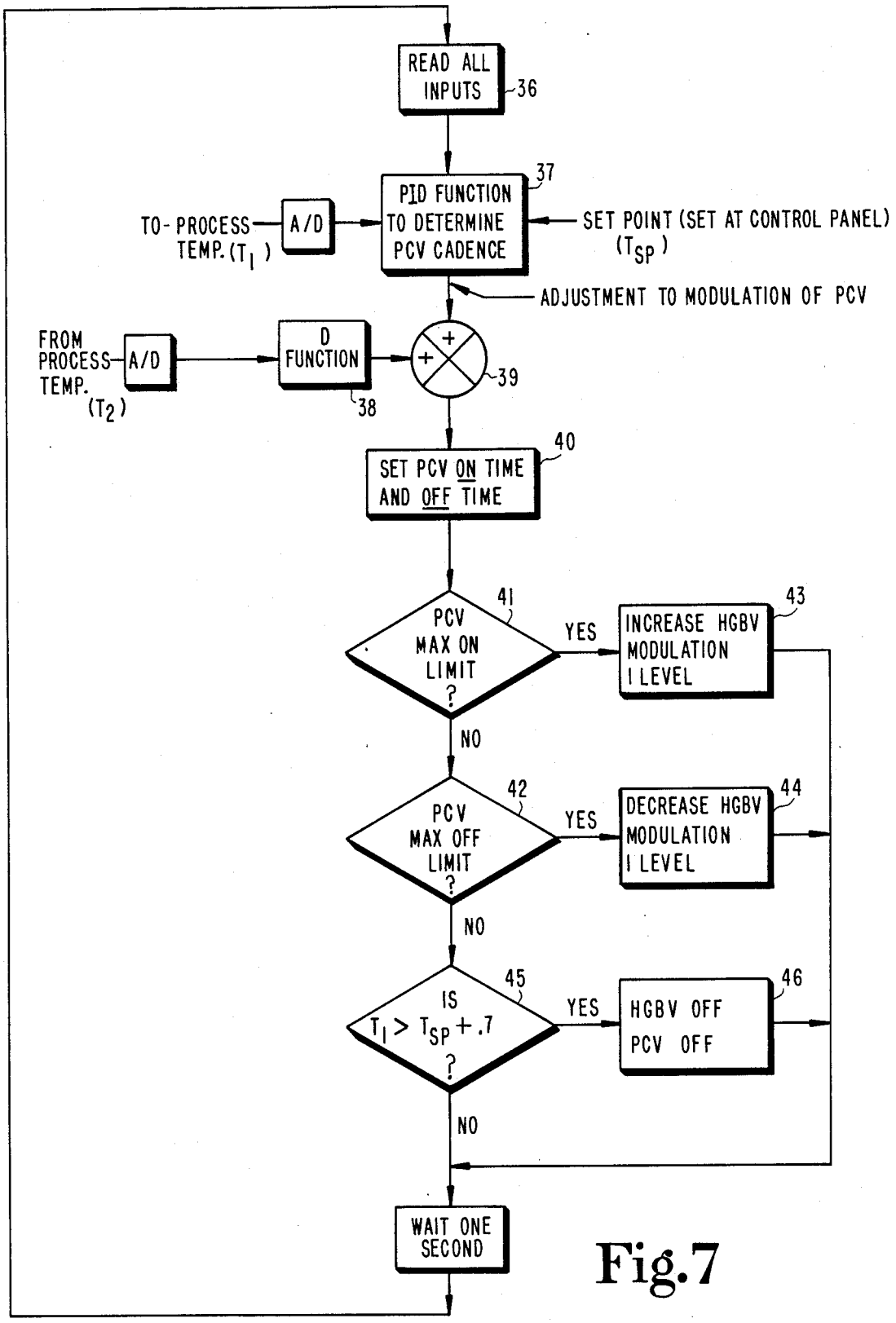
FIG. 7 is a general flow chart of the control algorithm.

Referring now to FIGS. 1 and 7, controller 8 reads (block 36 in FIG. 7) the desired coolant temperature $T_{sp}$ manually entered at the control panel (I/O block FIG. 6), the to-process temperature $T_1$, and the from-process temperature $T_2$. A proportional integral derivative (PID) function is developed (block 37) from the desired to-process temperature set point $T_{sp}$ manually entered at the control panel, and the actual to-process temperature $T_1$ obtained from sensor 18. The PID function calculation is initially scaled at some suitable steady-state load condition and HGBV modulation level zero, to output directly the necessary "on" and "off" times of the precision control valves. This PID function is combined (block 39) with a derivative (D) function (block 38) of the from-process temperature $T_2$ input obtained from sensor 29, to set the on and off times of the precision control valves (PCV) 12 and 17 (block 40). The precision control valve "on" and "off" periods are compared to 100% (blocks 41 and 42, respectively) and, if either equals 100%, an appropriate change in hot gas by-pass modulation level will be made (blocks 43 or 44). Generally speaking, if the actual to-process temperature is lower than the set point, and if a duty-cycle full-time on for valve 12 and off for valve 17 is not adequate to get the temperature up to the set point level, the "PCV max on limit" will be exceeded to command an increase in the modulation level of the hot-gas by-pass valve by one level (block 43). Thus, the hot-gas by-pass valve will remain open longer. On the other hand, if the PCV maximum off limit is reached (block 42), the hot-gas by-pass valve modulation will be decreased one level. Finally, if the present value of the to-process temperature $T_1$ is greater than the set point temperature plus an offset of 0.7° F., (block 45) it will signal full-time off conditions (block 46) for both the hot-gas by-pass valve and the precision control valve 12. There is a one second period until the information processing cycle repeats.

Figure 8:
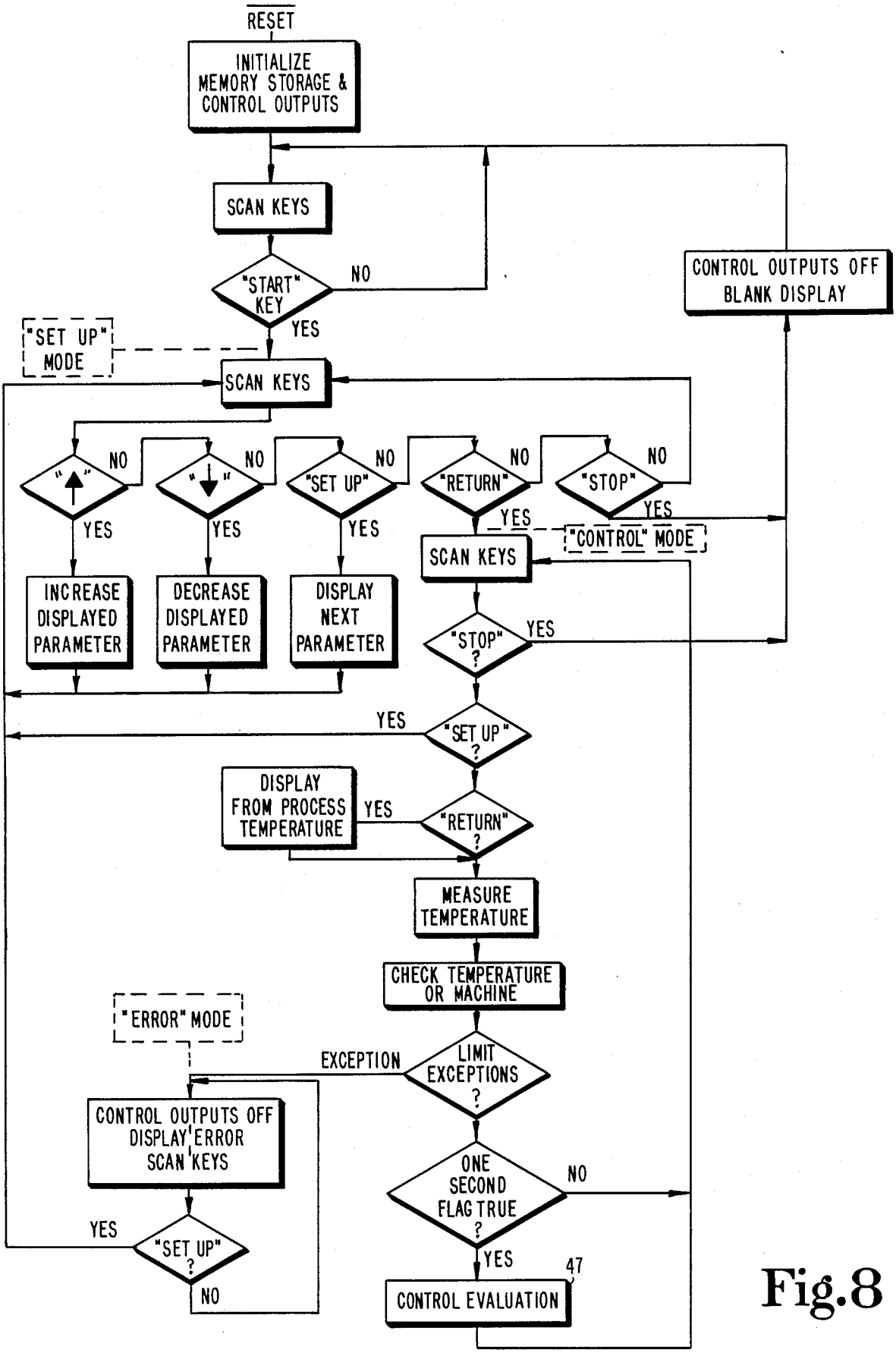
FIG. 8 is a flow chart for a portion of the controller outlining the "setup mode", the "control mode" and the "error" mode.

The algorithm described above is within the "control mode" portion of the diagram of FIG. 8. That diagram also includes the "set-up mode" routine and the "error mode" routine. The set-up mode is for the purpose of entering the desired parameters in RAM (FIG. 6). The error mode is for alerting the operator to set-up or operating conditions which the system cannot handle. Further description of these modes would be superfluous.

Figure 9:
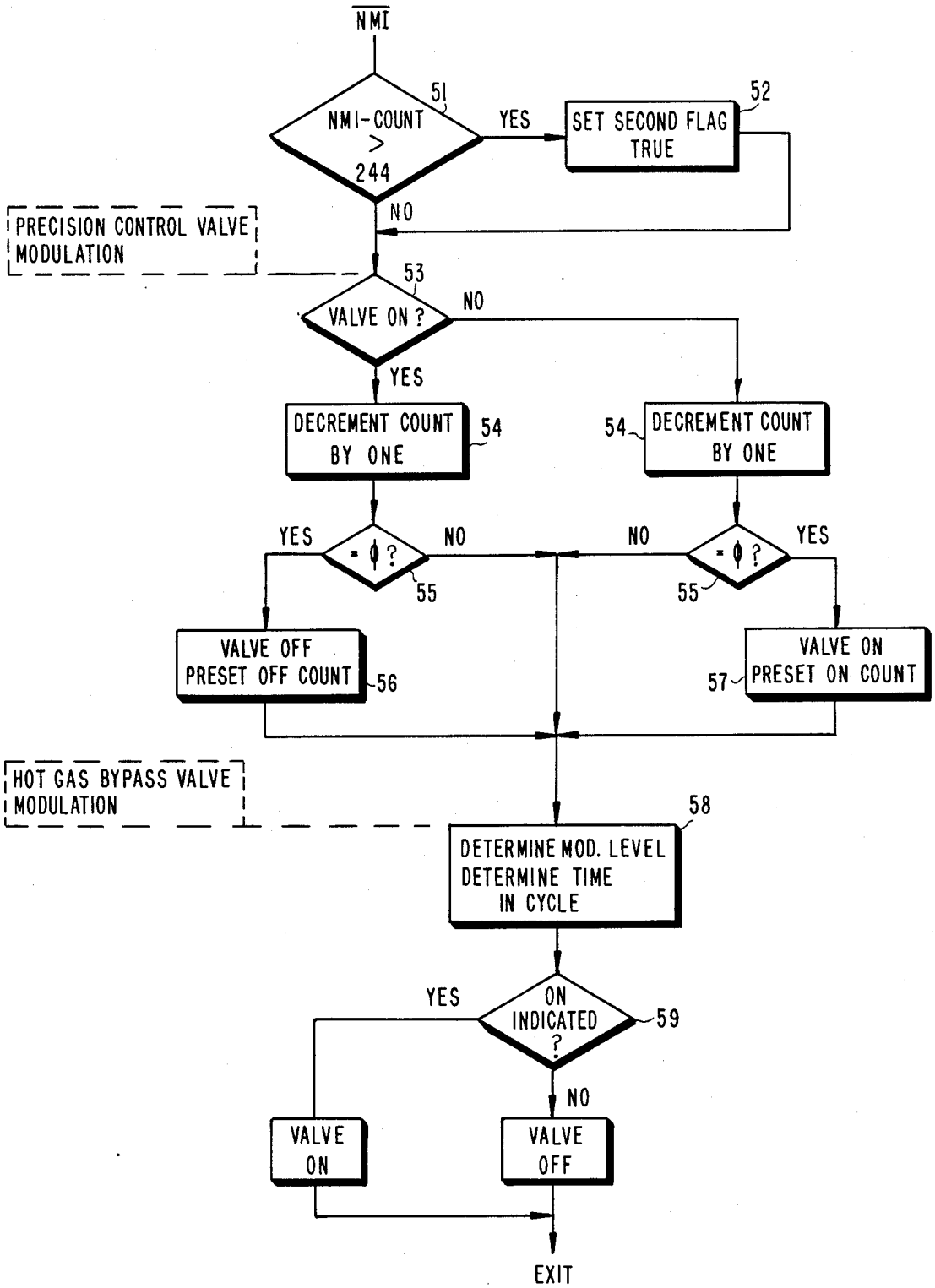
FIG. 9 is a chart of the portion of the program for the cadences of the valves.

Referring to FIG. 9, the NMI routine is shown. As mentioned above, the rate is established by dividing the 1 Mhz clock rate by 4096 (FIG. 6). When the NMI occurs, a section of code that affects the modulation of both the precision control valve and the hot gas by-pass valve are executed. The interrupts are counted (block 51) (FIG. 9) to set the one second flag true (block 52) when the count exceeds 244. For each interrupt, the status of the PCV is checked (block 53), i.e. whether the valve is on or off. Regardless of the valve condition, there is a one count decrement (blocks 54) of the counter that is being maintained to keep track of how long the valve is to stay in that state, either on or off. If the count has not expired to zero (blocks 55), the process proceeds on to hot gas by-pass valve modulation. If the count for the valve condition (blocks 55) has expired and has gone to zero, and if the valve was "on", then it will signal shut-off and preset the off count. In other words, it will then turn the valve off and it will determine the amount of time it is to remain off. Then the process will advance to gas by-pass valve modulation. So, up to this point, if the PCV valve 12 is in a particular state, it remains in that state until the count is decremented to zero. When the count decrements to zero, it puts the valve in the opposite state and presets a software counter to allow the counter to determine how long it will stay in that state. Separate from the NMI procedures, the control algorithm reference stack, determines what the prescribed "on" count and "off" count should be. If there is an adjustment needed on those, as determined by the process of FIG. 7, it is only effective when the current count expires. The control algorithm does not preempt the current count and modify it at that point. It waits until the current "on" or "off" count has expired, and then implements any needed adjustment in the PCV modulation.

Referring to the portion of FIG. 9, where it shows the hot gas by-pass valve modulation, the process uses some data from a previous portion of the program (blocks 41 and 42 in FIG. 7) to determine the modulation level, 0, 1, 2, 3 or so forth (block 58 in FIG. 9) and to also determine how far in the cycle it has come. Here a thirty-second counter counts from 0 to 30 over and over again. And this program looks at that count each second and, for the given level and a given amount of time into the cycle, it uses a table (such as Table II above) to determine whether the hot-gas by-pass valve should be on or off. So, as indicated at block 58, it determines the level, determines the time in the cycle, and then (block 59) it asks the questions: Is "on" indicated for the HGBV at this time in the cycle? If the answer is "yes", it turns the valve 9 on. If the answer is "no", it turns the valve off. At that point, the interrupt routine is complete and the processor returns to the other portion of the program that was interrupted when the NMI occurred.

Returning to the top of the diagram of FIG. 9, when the "set second flag true" occurs, that determines the advance of second counters in the control. The control evaluation (block 47, FIG. 8) that is done once a second, is based on this logic. Also, the 30 second cycle that is used for hot gas by-pass valve modulation is also based on that "second flag true" state. Every time it is set true, the counter increments by one to determine the 30 second cycle.

In general, and referring to FIG. 7, when the calculation is made to set the "on" and "off" time for the PCV, it is the "on" time that is calculated. And then the "off" time is determined by subtracting the "on" time from 4 seconds. Because of physical limitations of valves, there is a certain minimum limit of "on" time and a certain maximum "on" time that can be achieved within 4 seconds. Outside these limits it is necessary to quit cycling and have the PCV go to full on or full off. In other words, the PCV is not time modulated all the way down to zero, but only down to, about a quarter of a second, and then it is just shut off. It is left off until the control determines the need to turn it back on. Where the decision is made, if the off count is too short, another branch (not shown) in the routine, will keep the valve on until there is an instruction to modify it differently.

In summary, when a control evaluation indicates that the "off" time or the "on" time is to be too short to be electro-mechanically feasible, an appropriate decision can be made such that, for example, if "off" count is so short that it is below some limit, then the valve is left on continuously and not turned off until a control evaluation indicates the off count is long enough to be effected and effective.

Having described the valve modulation, it can be understood that the controller response to sensor 29 will detect a change in the temperature of the water from the laser returning in line 13, and thereby anticipates the need for a change in the refrigeration capacity, so the controller 8 may thereupon open valve 12 and close valve 17. Thus, some of the pump discharge water is permitted to by-pass the load and, instead, pass through the heat exchanger 3 where it will pick up heat from the hot gas flowing in line 21 from the compressor. The refrigerant from the heat exchanger 3 enters the condenser 2.

The sensor 18 will detect the increase of coolant water mix temperature leaving the reservoir and, when it has increased to the desired level, the controller 8 will respond and may increase the open time for valve 17 and closed time for valve 12. If the heat added to the water by heat exchanger 3 is not sufficient to offset the refrigeration capacity of the system enough to keep the temperature up at a level where it is to be kept, the controller 8 will respond, detecting the temperature lower than desired, and open or increase the modulation level (open time) of the hot gas by-pass valve 9 to further reduce the cooling performance of the refrigeration system. Then, if the coolant water temperature rises above the desired level, the controller will respond, to decrease the open time of valve 12 and closed time of valve 17, again to reduce or discontinue adding heat to water in heat exchanger 3. The choice and timing between operation of valves 12, 17 and 9 will depend upon the operation of the controller as described above in response to the process equipment cooling water heating loads encountered by the system.

The present invention has the advantage of avoiding rapid and radical changes in the temperature of the process equipment cooling water, by using a fairly substantial water capacity in the reservoir, providing for heat addition from the refrigeration equipment to the process coolant water, by adding heat to the water from some refrigerant out of the high pressure side of the compressor, and sensing cooling water temperature at strategic points so that the control is immediately responsive to the heat loading at the processing equipment and to the heat addition from the refrigeration equipment. While the immersion type of evaporator employed in the present invention is less efficient than state-of-the-art refrigerant evaporators, that very fact is an asset implemented according to the present invention to achieve the precision control of coolant temperature to the process such that it may be controlled within plus or minus 1° F. of the desired value.

In an example of the operating system of the present invention, some relevant components are as follows:

Compressor size 10 HP; Refrigerant Freon 22.

High side line 22 dia.: 5/16" OD copper.

High side line 21 dia.: ½" OD copper.

Evaporator refrigerant line size diameter, 1¼" OD out and ⅞" OD in.

Number of coils 19 in tank: 60.

Diameter of coils 19 in tank: 2½" OD.

Evaporator tank 5.

Dimensions: length 40½", width 18¼", height 17 ½".

Transducers 18 and 29: Model AD590J integrated circuit temperature transducer by Analog Device Company of Route 1, Industrial Park, Norwood, Mass.

Coolant type: water 70% glycol 30%. Volume of reservoir 56 gal. max.; operating vol. 49 gallon.

Percentage of coolant returned in line 14: about 50% when valve 17 open.

Percentage of coolant returned in line 16: about 50% when valve 17 open.

Percentage of coolant by-passed in line 15: zero to 10% based on percent of time valve 12 is open.

Percentage of coolant by-passed in line 27: approximately 5%.

Cooling load range 11,160 to 111,600 BTU/hr.

Control Hardware

Microprocessor—8 BIT, Motorola 6809

Memory, Program—16 Kilobytes EPROM

Memory, Data—2 Kilobytes RAM

I/O—11 BIT A/D Converter

Temperature Transducers—Solid State, 0.2° F. absolute accuracy over 0 ° to 100° F. span.

In the claims which follow hereinafter, the term "expansion valve" is used in a generic sense to describe the refrigerant pressure reducing device of whatever nature it may be, regardless of whether it is a capillary tube, thermostatic expansion valve, stepper-operated needle valve, or other device.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of precisely controlling the temperature of a coolant for a process and comprising the steps of:

circulating the process coolant through a load circuit to remove heat from processing equipment;

returning process-heated coolant through a tank having refrigerant conveying and evaporating heat exchanger means of a refrigeration system therein;

sensing temperature of returned coolant; and responding to sensed temperature below a desired point to transfer heat from hot gas in said refrigerating system to a portion of the coolant returned to the tank;

dividing the returning process coolant into a path directly to the tank and a path through a normally-open valve to the tank;

delivering coolant from the tank to a path through a normally-closed valve and a heat exchanger back to the tank; and switching the conditions of the valves in said responding step to pass coolant through the heat exchanger to there transfer the heat from the hot gas to the coolant therein.

2. The method of claim 1 and further comprising the step of:

mixing the returning coolant from the said paths in the tank.

3. The method of claim 1 and further comprising the steps of:

establishing and maintaining on-off duty cycles of a hot-gas by-pass valve of the refrigeration system; and responding to the sensed temperature below the desired point by increasing the "on" periods in the duty cycle.

4. The method of claim 3 and further comprising the steps of:

establishing and maintaining on-off periods of a control valve in a coolant line through a heat transfer device for the said transfer of heat from the hot gas, and further responding to sensed temperature changes by changing "on" times of said control valve more frequently than "on" periods are increased for the hot-gas by-pass valve.

5. A method of precisely controlling the temperature of a coolant for a process and comprising the steps of:

circulating the process coolant through a load circuit to remove heat from processing equipment;

returning process-heated coolant through a tank having refrigerant conveying and evaporating heat exchanger means of a refrigeration system therein;

sensing temperature of returned coolant; and responding to sensed temperature below a desired point to transfer heat from hot gas in said refrigerating system to a portion of the coolant returned to the tank;

establishing and maintaining duty cycles of on-off periods of a control valve in a coolant line through a heat transfer device for the said transfer of heat from the hot gas, and responding to the sensed temperature below the desired point by increasing the "on" periods in the duty cycle.

* * * * *